United States Patent [19]

Cousins

[11] 4,183,121

[45] Jan. 15, 1980

[54] SEPARABLE FASTENER

[75] Inventor: Sydne Cousins, New York, N.Y.

[73] Assignee: Bonnie Enterprises, Inc., Cranford, N.J.

[21] Appl. No.: 843,762

[22] Filed: Oct. 20, 1977

[51] Int. Cl.[2] ..... A44B 17/00

[52] U.S. Cl. ..... 24/204; 24/206 R; 24/201 HE

[58] Field of Search ..... 24/206 A, 206 R, 204, 24/201 HE, 201 HH, 16 PB, 205.13 D, 205.12; 46/25, 28, 30

[56] References Cited

U.S. PATENT DOCUMENTS

| | | | |
|---|---|---|---|
| 466,803 | 1/1892 | Schodsky | 24/206 R |
| 1,600,279 | 9/1926 | Epstein | 24/204 |
| 1,746,565 | 2/1930 | Sundback | 24/205.12 |
| 2,482,846 | 9/1949 | Fox | 24/206 R |
| 2,629,911 | 3/1953 | Macy | 24/205.13 D |
| 3,200,464 | 8/1965 | Cousins | 24/230 R |
| 3,263,292 | 8/1966 | Fekete | 24/206 R |
| 3,484,907 | 12/1969 | Elsenheimer | 24/204 |
| 3,704,490 | 12/1972 | Hansen | 24/205.13 D |

FOREIGN PATENT DOCUMENTS

| | | | |
|---|---|---|---|
| 1600305 | 1/1970 | Fed. Rep. of Germany | 24/16 PB |
| 493872 | 8/1919 | France | 24/201 HE |
| 956320 | 1/1950 | France | 24/205.13 D |
| 1467491 | 12/1966 | France | 24/204 |
| 421528 | 5/1947 | Italy | 24/205.12 |

*Primary Examiner*—Bernard A. Gelak

[57] ABSTRACT

An improved separable fastener composed of two opposed, mating elongated strips with a series of flexible interengaging tongues offset from and in parallel alignment with one of the axes of the strips, and partially overlapping openings in the strips. By placing the strips in opposed abutment and then applying a compressive force, the ends of the opposing mating tongues partially displace each other and then snap into engagement with each tongue being received in the corresponding opening of the opposed strip.

15 Claims, 13 Drawing Figures

SEPARABLE FASTENER

PRIOR ART

This invention relates to improved separable fasteners, and more particularly to a fastener comprising a series of thin flexible strips having opposing engaging tongues, allowing very rapid engagement and disengagement.

Among the more common means of joining two elements together have been dot or snap fasteners, zippers and Velcro strips. The dot and snap fasteners are bulky and, to a certain extent, somewhat rigid, as well as being relatively expensive to fabricate. The Velcro strips are not rigid, but are very expensive to fabricate; in addition, one of the major drawbacks has been their low tensile strength. Furthermore, continued machine washing and drying, as well as perma-press treatment rapidly ruins the effectiveness of the strips.

During the course of grappling with the problem of fasteners, I have developed certain prior art means of overcoming the problems present in fastening undergarments, such as brassieres. Examples of such attempted solutions are U.S. Pat. Nos. 3,200,464 and 3,798,711. However, these clasps, while less so than the above-mentioned fasteners, are somewhat bulky and rigid and have proven somewhat difficult to fasten and unfasten.

Other attempts to resolve the problems of fastening such items as brassiers have centered on standard brassiere hook clasps. However, these clasps dig into the body and the metal or rigid plastic portions tend to rub in the wrong direction, causing irritation and pain to the user. Furthermore, because of their bulk and rigidity, the clasps have a tendency to rip through the fabric of the brassiere, and sometimes the outer garment.

SUMMARY OF THE PRESENT INVENTION

Accordingly, among the principal objects of the present invention is the provision of an improved separable fastener, which is completely adjustable and pliable, thus helping to insure that the brassiere fits properly around the body of the user.

Still yet another object of the present invention is to provide an improved separable fastener which is pliable and thin, thus insuring that there are no protrusions or rigid bodies to hurt or otherwise irritate the body of the user, while still giving a proper holding force.

Still yet another object of the present invention is to provide an improved separable fastener which may be made very thin, thus insuring that there are no bulky parts.

Still yet another object of the present invention is to provide a separable fastener of the character described which will allow the provision of a natural and smooth line while performing its desired function.

Still yet another object of the present invention is to provide a thin and naturally fitting separable fastener which will not show through the outer garments of the wearer, enhancing the attractiveness of clothes, such as see-thru fashions.

Still yet another object of the present invention is to provide an improved separable fastener which may be utilized outside of the brassiere industry, having utility for men's and children's clothing, for toys, and perhaps sheets and pillow cases. In fact, this invention has utility in any areas where it is desired to have an effective inexpensive means of securing two elements together.

Still yet another object of the present invention is to provide a separable fastener of the character described which will be simple to manufacture and assemble and yet will be durable to a high degree in use.

Still yet another object of the present invention is to provide an improved separable fastener which may be made utilizing novel methods of manufacture, thus providing for unexpected economies in fabricating the finished product.

In accordance with the present invention, there are providing two mating strips in which there is at least one longitudinal row having a series of holes aligned across the major horizontal access. In a preferred construction there are at least two rows of holes, the rows being aligned with each other so that the corresponding holes of each longitudinal row are in vertical alignment across the minor axis. One of the horizontal rows may be longer than the other to guide the user in ascertaining the direction of compressive alignment.

Dispose above each opening and partially overlying it is a tongue offset from the main body of the strip but in parallel alignment therewith. The forward edge of each tongue has a straight inclined shoulder parallel to either the major or minor axis. When a strip is placed over another strip so that they are in proper aligned engagement, and when a compressive force is applied to both strips, the oppositely disposed overlapping tongues, which are flexible, will be slightly displaced to allow the tongues to be snapped by each other and received in the opening below the other tongue, with the small amount overlapping between the two tongues to insure a mating engagement.

The above brief description, as well as further objects, features and advantages of the present invention will be more fully appreciated by reference to the follow, detailed description of the preferred, but nonetheless illustrative, embodiment when taken in conjunction with the accompanying drawings, wherein:

FIG. 8 is a view showing two engaged strips joining oppositely disposed tapes attached to a garment or the like;

DESCRIPTION OF THE PREFERRED EMBODIMENTS

Figure 1:
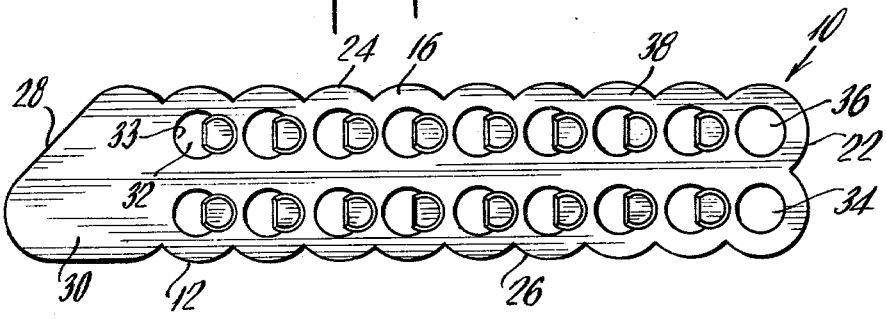
FIG. 1 is a plan view of a strip made in accordance with the present invention.
Figure 7:
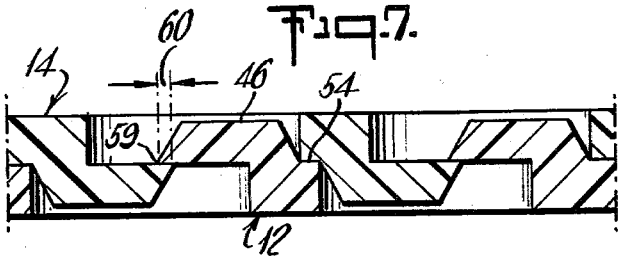
FIG. 7 is an enlarged cross-sectional view taken along the lines 7—7 of FIG. 6.
Figure 8:
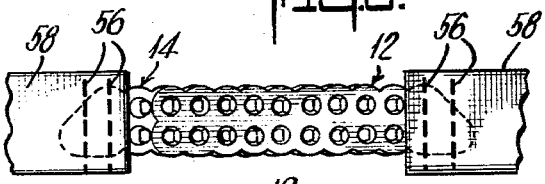

Referring now to the drawings, and more particularly to FIGS. 1 and 8, there is shown a separable fastener 10 comprising a lower member 12 and an upper member 14 (FIG. 7). In referring to the two elements of the fastener, the references upper and lower will be used in connection with their juxtposition as best seen in FIGS. 7 and 8.

Figure 4:
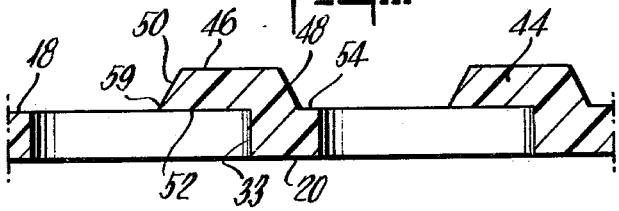
FIG. 4 is a further enlarged cross-sectional view taken along the lines 4—4 of FIG. 2.
Figure 5:
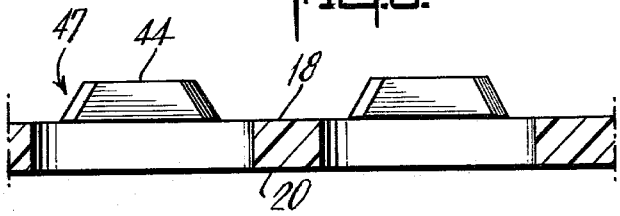
FIG. 5 is an enlarged cross-sectional view taken along the lines 5—5 of FIG. 2.
Figure 3:
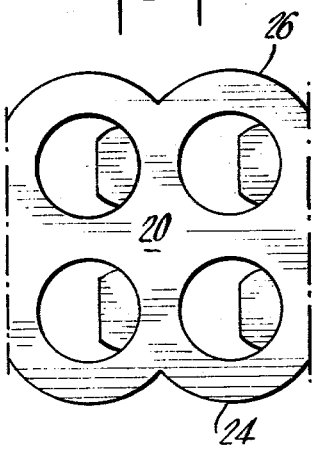
FIG. 3 is a bottom plan view of FIG. 2.

Now referring to FIG. 1, the lower member 12 is in the shape of a strip 16 which is essentially "scalloped" in appearance. More specifically, and referring to FIG. 4 as well as FIG. 1, the strip is defined by an upper or first surface 18, and a lower or second surface 20. These surfaces each lie in a single plane. However, it is understood that the strips themselves are made of flexible material so they may be twisted and bent. The strips may be made by injection molding of any type of flexible material, including, but not limited to plastics. Furthermore, the strips may be of any desired size, although it is preferable that the dimensions are sufficient to allow proper sewing or bonding of the strips to the portions to be connected. This will be discussed in further detail below.

Once again, looking at FIG. 1, the strip is further defined by a right side wall 22, a top wall 24, a bottom wall 26, and a left side wall 28. Because of the scalloped shape of the strip, these walls define a generally partially continuing cylindrical appearance in cross section. Of course, if it is desired, the outer walls may be straight in appearance and in fact, may be any desired appearance. The shape of these walls do not form part of the invention. Extending inwardly from the left side wall 28 there is a solid portion 30 in the general shape of a right angle triangle. The reason for this extension will be explained below.

The strip itself contains a series of holes 32 defined by an inner cylindrical wall 33. The holes may form a lower horizontal row 34 and an upper horizontal row 36. Each of these horizontal rows pass through what may be defined as an axis parallel in alignment with the major axis of the strip. Furthermore each of the holes in one row are in vertical alignment with holes in the other row, thus forming a series of rows whose axis is parallel to and in alignment with the minor axis of the strip.

Figure 2:
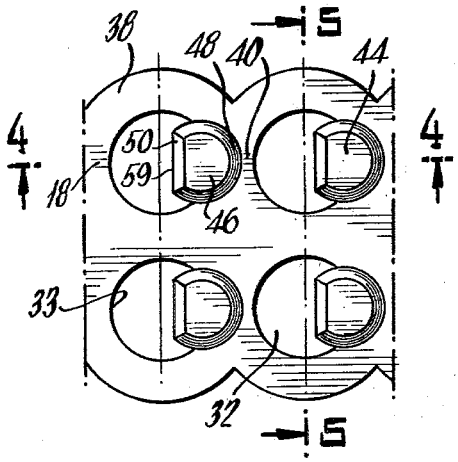
FIG. 2 is an enlarged fragmentary view of a portion of the strip of FIG. 1.

Referring to FIG. 2, the portions of the strip surrounding the holes define an outer shelf portion 38 terminating at the walls 22, 24, 26, 28. A neck portion 40 is defined between the holes and depending from the outer shelf portion. The neck portion blends into a inner shelf portion 42. Turning to FIGS. 4–7, there is shown a series of tongues 44 associated with each hole. The major portion of the tongues are offset from the first surface of the body of the strip but are parallel thereto. Furthermore, a minor portion of the tongues overlap a portion of the holes 32. The tongues represent a truncated conical section in shape, defined by a top wall 46, and an encircling shoulder 47 which has a sloping encircling conical shoulder portion 48 and a projecting straight inclined shoulder portion 50. The tongue is finally defined by a bottom wall 52 which merges into the inner cylindrical wall 33 of the hole 32. Opposite to the shoulder portion 50 and forming part of the neck portion 40 of the top surface 18 is an abutment section 54 for the purpose hereinafter appearing.

As stated above, each one of the holes has an overlapping and projecting tongue 44. However, it has been found that for ease of securement and detachment, the last holes in each row adjacent to right side wall 22 on each strip are left without overlapping tongues and the location of the last one upper hole and lower two holes adjacent to wall 28 (for the illustrated preferred embodiment), is formed as a solid portion 30. The tongues may be in the direction shown in FIG. 1 or may be rotated 90° so that the tongues lie along the axes parallel to the minor axis of the strip. Although the lower member 12 was used for purposes of illustrating the construction of the strip, it is understood that the upper member is essentially the same construction.

Figure 6:
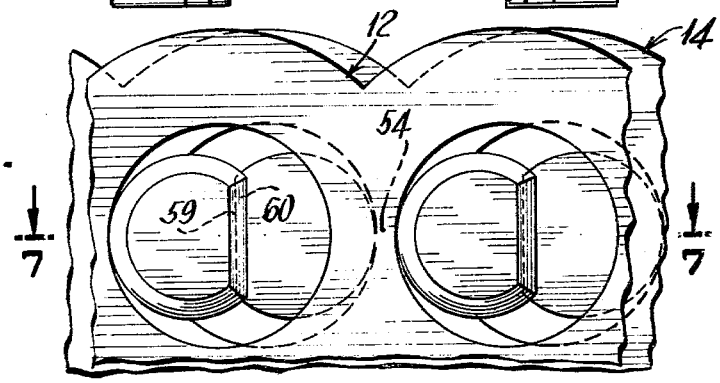
FIG. 6 is an enlarged, fragmentary view of two strips in mating engagement with the underlying strip illustrated in phantom where appropriate.

In order to use the strips, it is necessary to somehow adhere the strips to a piece of material of some nature which is to be made into another piece of material. FIG. 8 shows an example of this in which stitching is applied to the portion 30, the stitching being identified by numeral 56 securing the strips to tapes 58. Two overlying strips are then placed in position together as shown in FIG. 8 and then a compressive force is applied to the strips. The tongues, being also made of the same flexible material as the strips, and in fact, being formed integrally therewith during the fabrication operation, are slightly resilient. Initially, the apexes 59 of the mating, opposing tongues come into abutment. Further compressive force will cause a certain amount of displacement on the part of both tongues in the nature of a cantilever lever. Continued displacement will cause the apexes 59 of the two tongues to pass each other and then the tongues will snap back into position as best shown in FIGS. 6 and 7. A portion of each opposing tongue, formed near the apex of the walls 50, 52 and defined by the reference numeral 60, ultimately abut each other. In the same fashion opposing surfaces 54 of portion 40 abut each other. The tongues are designed in height so as to be comfortably received within the openings 32 and not to protrude beyond. Therefore, the thickness of the separable fastener is equivalent to twice the thickness of the holes.

Figure 9:
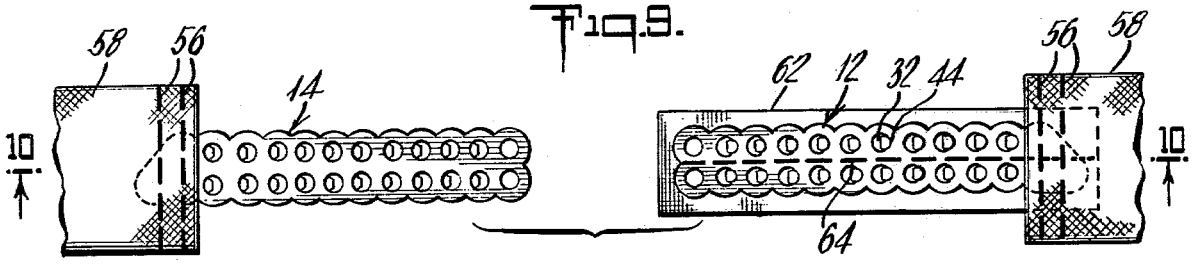
FIG. 9 is an exploded view of strips attached to tapes as in FIG. 8 with an additional fabric tape underlying the strip normally abutting the body of the wearer.
Figure 10:
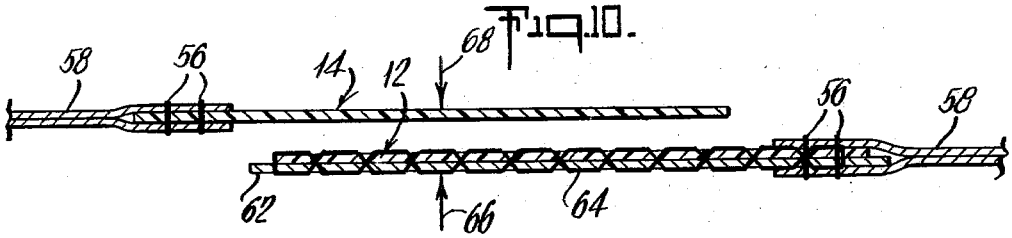
FIG. 10 is a cross-sectional view taken along the lines 10—10 of FIG. 9 with the upper strip overlying the lower strip prior to engagement.

Turning to FIGS. 9 and 10, there is shown a slightly modified embodiment of the underlying structure of the present invention, but very similar to FIG. 8. The distinction is that in FIG. 9 there is an additional strip of tape 62 underlying the lowermost of the mating strips 12. The tape 62 is joined to the strip 12 by means of stitching 64. This is all accomplished in the wellknown manner. It can also be seen that the tape 58 is formed of two portions which become readily apparent in this view, and the two portions form a receptacle in which both the tape 62 and the stripping 12 are received and stitched to the tape 58. The purpose of the underlying tape 62 is to provide a more comfortable surface to engage the body of the wearer. The tape 62 is obviously a smooth piece of material and does not have the openings 32 which might otherwise be considered an irritant by some users. FIG. 10 shows the strips aligned, just prior to being secured together by the illustrated compressive force 66, 68.

Figure 11:
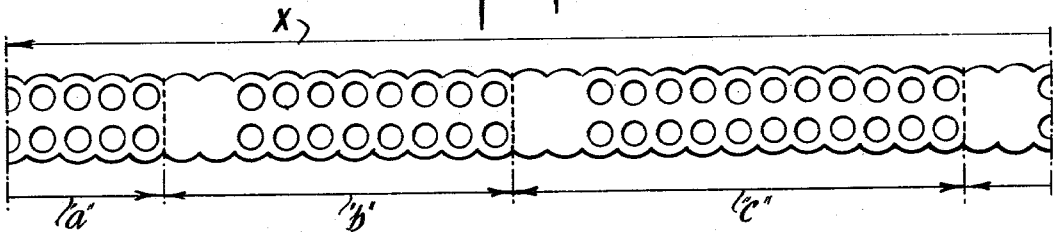
FIG. 11 is a plan view of a continuous strip made in accordance with the manufacturing requirements in which it is illustrated that insertions may be made at the mold at varying points to vary the lengths of the strip.

FIG. 11 is illustrative of the form of manufacture of the present tape material. The strip is illustrated as having a total length "X." But it can be seen that by placing fillers within the molds at certain points it is possible to obtain varying lengths of strips "a," "b," and "c," etc. Thus, the use of such a strip of continuing material provides the ability to utilize a mold which may produce strips of varying length, according to the particular order then being made by the manufacturer. This greatly facilitates the production process and also decrease the ultimate costs of the item.

Figure 12:
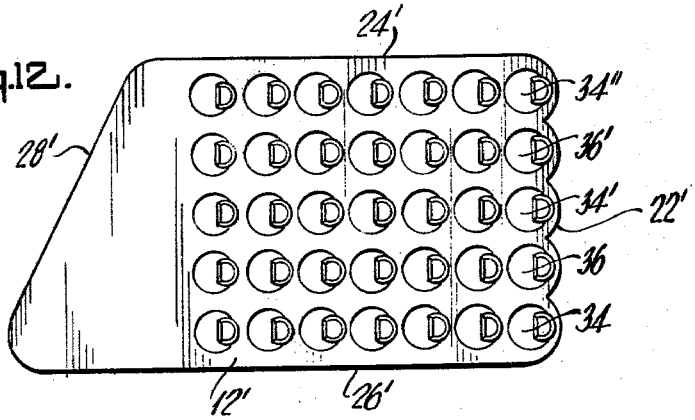
FIG. 12 is a plan view of a strip having more than two parallel rows with associated tongues longitudinally positioned along the strip.

FIG. 12 illustrates the flexibility of design of the current invention and illustrates a strip 12' having five rows of horizontal holes 34, 36, 34', 36' and 34''. The portion 30' is greatly elongated but is still in the general shape of a right-angle triangle and the walls 24', 22', 26' are straight edges rather than having a scalloped appearance. It is obvious that such a strip will have much greater tensile strength.

Figure 13:
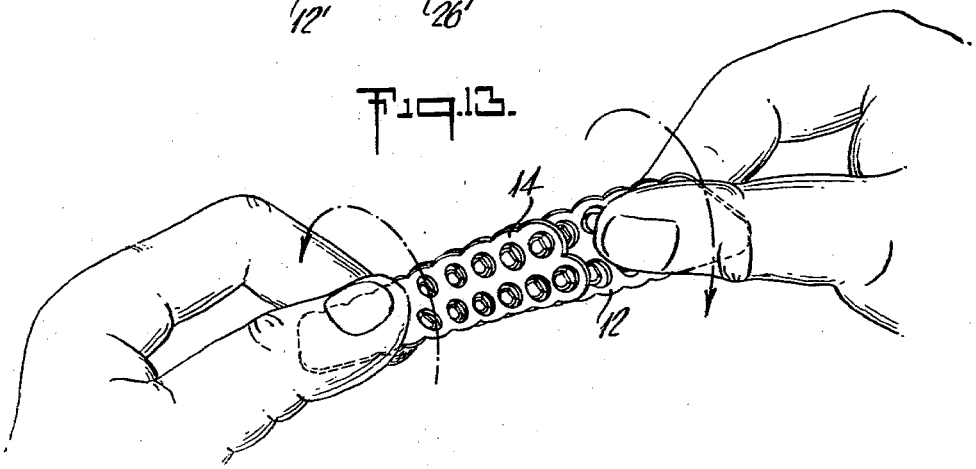
FIG. 13 is a perspective view illustrating the ability of the mating strips to withstand twisting stress and strain.

FIG. 13 illustrates the ease in which the strips may be twisted and rotated in opposite directions, without disengagement. The engagement is much more positive and much stronger than the Velcro strips, which are the only other comparable separable fasteners having such rotational movement.

It has been found that the above constructions are useful for all types of garments, in addition for undergarments, such as brassieres. Furthermore, they may be used for scarfs, skirts, and in fact, all types of clothing requiring some form of closure. Furthermore, it may be used to replace zippers, especially with respect to the means for starting and completion of separated zipper portions.

Because of the tensile holding nature of the construction, the invention has great utility in industries requiring closure of heavier materials. Among these are the medical arts in which it may be desired to retain a blanket in a close position around a patient suffering from shock or exposure.

It is further understood that the number of horizontal rows, and hence the number of holes aligned vertically can be varied from anywheres from 1 upwardly of any desired number. The more the rows, obviously the greater the tensile gripping strength.

Because of the repetitive nature of the construction, it is very simple to manufacture separable fasteners of different lengths, simply by placing a filler portion in an elongated mold. Thus, the lengths may be limited to one inch, two inches, six inches depending upon the placement of a filler portion in a mold that might normally be twelve to eighteen inches in length. Obviously, the thickness of the strips may be varied, as well as the number of horizontal holes and the direction of the tongues, depending upon the requirement of the closure for a specific application. For the nature of the closure it is not necessary that all the horizontal rows be in alignment to obtain the proper closure effect. For example, as shown in the drawings, only one of the two horizontal rows may be engaged during the mating operation, and there will still be sufficient tensile strength to maintain the closure.

In order to increase the compressive tensile strength of the closure, it is only necessary to increase the thickness of the tongue. It is understood that the tongue may be so thick as to extend beyond the dimension of the hole 32.

While it has been described and illustrate preferred embodiments of the present invention, it is apparent that numerous alterations, additions and omissions may be made without departing from the spirit thereof.

I claim:

1. A separable fastener device comprising:

a pair of complementary mating strips, each strip comprising a body having a substantially flat first face at least one portion of spaced openings extending along one of the axes and a plurality of tongues forwardly projecting from said strip, with each tongue having a flat underside substantially parallel to said first face and having a major portion offset from said strip and having a minor portion overlapping said opening and partially covering the latter with the free end of said tongue extending less half the distance to the opposing edge of said opening, each of said tongues having a degree of flexibility and being sized to fit snugly within the corresponding portion of a corresponding opening of the opposite strip with a snap fit when one strip is placed upon the other strip with the first surfaces thereof facing each other and the uncovered portions of the openings of each strip registering with the tongues of the opposite strips, whereby when the opposite second surfaces of said strips are pressed toward each other, said tongues are flexed and transversely bypass each other and engage respective openings in opposite strips whereby said strips are releasably locked together by said interfitting tongues and openings and the overlapping of said tongues.

2. The separable fastener device according to claim 1, said strip comprising an elongated body having a plurality of parallel rows extending longitudinally along one of the axes thereof.

3. The separable fastener device according to claim 2, the tongues being formed integrally with and projecting from a first surface of said strip.

4. The separable fastener device according to claim 2, the strip having at least two rows.

5. The separable fastener device according to claim 2, the tongue being a shape in the form of atruncated cone with a flatted inclined free end face and a bottom wall, said forward portion of the bottom wall engaging the forward portion of the oppositely disposed tongue.

6. The separable fastener device according to claim 5, each tongue being fully received within the opposed mating opening.

7. The separable fastener device according to claim 1, the strip having an outer shell portion defined between the end walls and the openings and having an inner shell portion defined between the openings with a neck portion defined therebetween.

8. The separable fastener device according to claim 7, the neck portion having an abutment section which abuts the oppositely opposed abutment section of the mating strip when the strips are in secured condition.

9. A separable fastener device comprising a pair of fastener members transferable between a separably coupled and uncoupled condition, each fastener member including a body strip having a plurality of longitudinally spaced openings therein and protuberances formed on a substantially flat first face of and integral with said strip adjacent to said openings and each protuberance including a first portion offset from a respective adjacent opening and a flexible tongue defining portion overlapping said respective adjacent opening and having a flat underside substantially parallel to said first face and a free outermost edge spaced less than half the distance from the opposing edge of the respective opening to define therewith an exposed portion of said opening, in said coupled condition of said fastener members said strip first faces being substantially superimposed with opposing tongues projecting in opposite directions and being disposed in the openings of respectively opposite strips and the underfaces of the free ends of opposing tongues being substantially superimposed, each of said tongues having a degree of flexibility and being dimensioned to fit snugly within the corresponding portion of a corresponding opening of the opposite strip with a snap-fit when one strip is placed upon the other strip with said first faces thereof confronting each other and the uncovered portions of the openings of each strip registering with the tongues of the respective opposite strips, whereby when the opposite second faces of said strips opposed to the respective first faces thereof are pressed toward each other in a direction perpendicular to said strip first faces, said tongues are flexed and transversely bypass each other and engage respective openings in opposite strips whereby said strips are releasably locked together by the underfaces of the free ends of opposing tongues being superimposed.

10. The separable fastener device of claim 9 wherein said protuberance first portions are longitudinally offset and adjacent to the edges of respective adjacent openings and said tongues project longitudinally therefrom.

11. The separable fastener device of claim 10 wherein the distance between the free outermost edge of each tongue is spaced from the opposing edge of the respective overlapped openings is less than the overall length of protuberance.

12. The separable fastener device of claim 11 wherein the peripheral free end face of each tongue is rearwardly outwardly inclined.

13. The separable fastener device of claim 11 wherein the peripheral face of each protuberance is tapered.

14. The separable fastener of claim 9 wherein the underface of each tongue is substantially coplaner with the first face of the respective body strip.

15. The separable fastener device of claim 9 wherein the height of each tongue does not substantially exceed thickness of the body strip.

* * * * *